United States Patent [19]

Bronson et al.

[11] Patent Number: 4,951,905

[45] Date of Patent: Aug. 28, 1990

[54] MAILBOX SUPPORT BRACKET

[76] Inventors: Kevin R. Bronson, 2917 Rolling Hills, Portage, Mich. 49002; Russell J. Bronson, III, 9288 Big Rock Dr., Kalamazoo, Mich. 49009

[21] Appl. No.: 352,480

[22] Filed: May 16, 1989

[51] Int. Cl.[5] ..... A47G 23/02

[52] U.S. Cl. ..... 248/152; 232/39; 248/300

[58] Field of Search ..... 248/152, 300, 145; 232/39

[56] References Cited

U.S. PATENT DOCUMENTS

| | | | |
|---|---|---|---|
| 3,229,940 | 1/1966 | Kangels | 248/145 X |
| 3,802,656 | 4/1974 | Virblas | 248/145 |
| 4,213,560 | 7/1980 | Hall | 248/156 X |
| 4,709,853 | 12/1987 | Hahn | 248/146 X |
| 4,726,468 | 2/1988 | Hesser et al. | 248/152 X |
| 4,793,551 | 12/1988 | Baylor | 232/39 X |

*Primary Examiner*—Ramon O. Ramirez

*Attorney, Agent, or Firm*—Flynn, Thiel, Boutell & Tanis

[57] ABSTRACT

A mailbox support device includes a generally horizontally extending main portion and an arrangement for facilitating a fixed support of a mailbox with respect to the main portion. A brace portion having first and second ends is operatively coupled to the main portion in a manner facilitating movement of the brace portion from a first position in which its second end is adjacent the main portion. A brace portion having first and second ends is operatively coupled to the main portion in a manner facilitating movement of the brace portion from a first position in which its second end is adjacent the main portion to a second position in which its second end is spaced from the main portion. The main portion includes an arrangement which facilitates a fixed connection of the main portion to a support, and the brace portion includes an arrangement which facilitates connecting the second end thereof to a support.

14 Claims, 2 Drawing Sheets

MAILBOX SUPPORT BRACKET

FIELD OF THE INVENTION

This invention relates to a support bracket for mounting a mailbox on a support and, more particularly, to an integrally formed support bracket for use in mounting a mailbox on a simple vertically extending post or on a horizontally extending arm.

BACKGROUND OF THE INVENTION

Mailboxes on rural roads and on urban roads which have no sidewalks are generally required to be located at the road for mail delivery from a postal service vehicle. In order to position the mailbox appropriately at the roadside, the box is generally placed on a post or the like. Therefore, there is a need for a bracket for use in mounting a mailbox on a post.

Due to factors such as wind, road traffic, and daily use of the mailbox by both the postman and the mailbox owner, a mailbox support bracket which securely mounts a mailbox on a post is extremely desirable.

Accordingly, it is an object of the present invention to provide a mailbox support bracket for securely mounting a mailbox on a post or the like.

It is a further object of the present invention to provide a mailbox support bracket, as aforesaid, which can be easily installed either on a simple vertically extending post, or on a horizontally extending arm.

It is a further object of the present invention to provide a mailbox support bracket, as aforesaid, which can be used with mailboxes of different sizes.

It is a further object of the present invention to provide a mailbox support bracket, as aforesaid, which is simple and inexpensive to manufacture.

SUMMARY OF THE INVENTION

The objects and purposes of the invention, including those set forth above, are met by providing a mailbox support device which includes a main portion, an arrangement for facilitating a fixed support of a mailbox with respect to the main portion, and a brace portion having first and second ends. An arrangement is provided for operatively coupling the first end of the brace portion to the main portion in a manner facilitating movement of the brace portion from a first position to a second position. The second end of the brace portion is respectively adjacent and spaced from the main portion in the first and second positions. The main portion includes an arrangement for facilitating a fixed connection of the main portion to a support, and the brace portion includes an arrangement for facilitating a fixed connection of its second end to a support.

BRIEF DESCRIPTION OF THE DRAWINGS

An exemplary embodiment of the invention will be described in detail hereinafter in connection with the drawings, in which.

DETAILED DESCRIPTION

Figure 1:
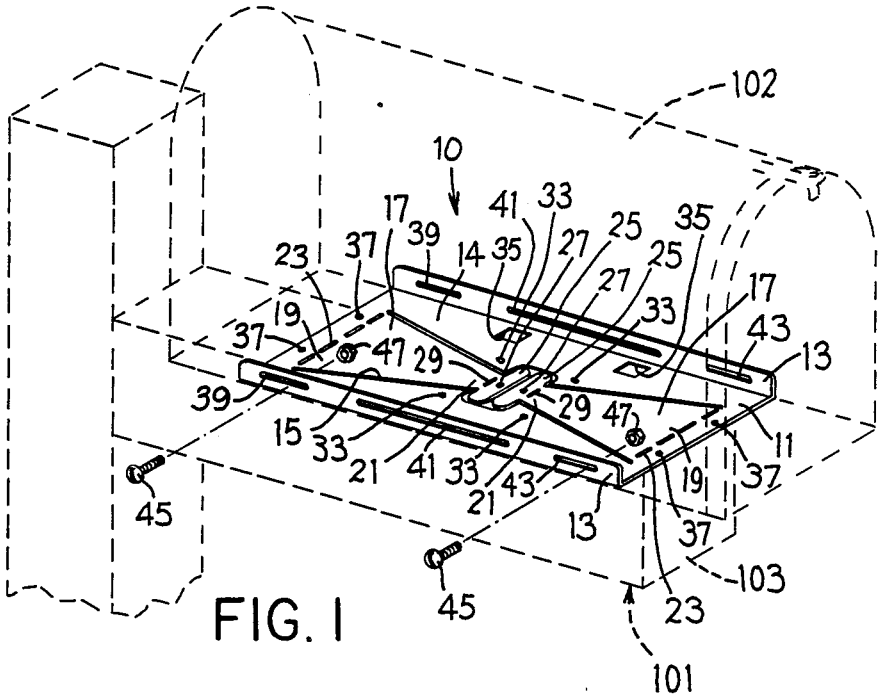
FIG. 1 is a perspective view of a support bracket embodying the present invention and showing how it is used to mount a mailbox on a horizontally extending arm.

Referring to FIG. 1, a support bracket 10 which embodies the present invention is an elongate channel-shaped bracket 13½ inches long having a main wall or web 11 connecting two side walls 13 which are about 6 3/16 inches apart. The side walls 13 extend in the same direction from the web 11 at approximately a 90° angle thereto. The side walls 13 extend from the web 11 to a height which is substantially smaller than the width of the web 11 and which in particular is about ⅞ inches. The bracket 10 is formed from a single piece of thin yet strong metal.

Figure 2:
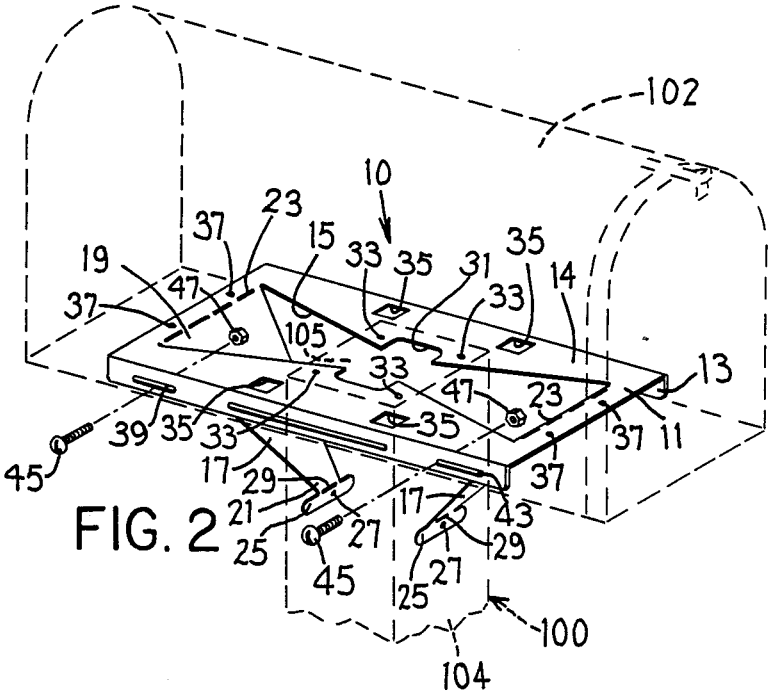
FIG. 2 is a perspective view of the support bracket of FIG. 1 but showing how it is used for mounting a mailbox on a post.

Referring to FIGS. 1 and 2, the web 11 includes a base portion 14 and two brace portions 17, the base portion 14 of web 11 having therein a generally hourglass-shaped cut-out 15 extending lengthwise in the web 11. The cut-out 15 is centered both longitudinally and transversely in the web 11. Disposed in the cut-out 15 are two brace portions 17 which as shown in FIG. 1 extend toward each other lengthwise of the web from the respective ends of cut-out 15 to a location near the center thereof. The brace portions 17 include fixed ends 19 near the respective ends of the cut-out 15 and free ends 21 near the center of the cut-out 15. The lateral edges of the brace portions 17 converge from the fixed ends 19 toward the free ends 21 in conformity with the generally hourglass-shape of the cut-out 15.

The brace portions 17 are integrally connected to the base portion 14 of the web 11 at their fixed ends 19, and the web 11 has a line of spaced, elongated perforations 23 which extend transversely across the fixed end 19 of each of the brace portions 17 in parallel relationship with the respective ends of the web 11. The rigidity of the material from which the bracket 10 is constructed is sufficient, along with the connection to the base portion 14 provided by the perforated segments 23, to hold the brace portions 17 generally in the same plane with the base portion 14 of the web 11.

The brace portions 17 are provided at their free ends 21 with tabs 25. The tabs 25 are elongated transversely so as to be wider than the narrow free ends 21 of the brace portions 17. The tabs 25 are rounded at their transverse ends and are spaced from each other a small distance at the longitudinal center of the web 11. Each tab 25 is integrally connected to the respective brace portion 17 and a single transverse slot or perforation 29 is provided at the conjunction thereof. The tabs 25 have circular screw holes 27 formed therethrough at the geometric center thereof. Because the tabs 25 are elongated in the transverse direction, the generally hourglass-shaped cut-out 15 has a transversely extended portion 31 at its center (FIG. 2).

The base portion 14 of the web 11 has formed therein four circular screw holes 33, one on each side of each brace portion 17. The holes 33 are located near the portion 31 of cut-out 15 so that each is the same distance from a respective end of the web 11. The holes 33 are also located so as to be equally distant from the respective side walls 13. Thus, the holes 33 are symmetric with respect to the geometric center of the web 11, and in particular define the corners of an imaginary square having sides which are preferably 2¾ inches.

The base portion 14 of the web 11 also has therein four square finger holes 35, one on each side of each brace portion 17. The holes 35 are formed adjacent the side walls 13 and are spaced equally from respective ends of the web 11 so as to be symmetric with respect to the geometric center of the web 11. The holes 35 are large enough for insertion of a finger therethrough, as discussed below, and are slightly offset from the holes 33 toward the ends of the web 11. The base portion 14 of the web 11 has further provided therein four circular screw holes 37, two between each line of perforations 23 and the associated end of the web 11. The circular holes 37 at each end are transversely aligned and preferably spaced from each other by $2\frac{3}{4}$ inches.

Each upstanding side wall 13 has three longitudinally extending elongate slots 39, 41 and 43 formed therein so as to be equally spaced between the web 11 and the remote edge of the side wall 13. The slots 39 and 43 are formed near the ends of the side walls 13 and are of equal length. The middle slot 41 is substantially longer than the slots 39 and 43. The slots 39 and 43 are spaced equally from respective ends of the side wall 13, and the slot 41 is centered between the slots 39 and 43.

The use of the inventive support bracket will now be described with reference to FIGS. 1 and 2. When used with a horizontal support arm 101, which is normally a 4 inch by 4 inch piece of wood, the bracket 10 is arranged so that the web 11 is centered with respect to the width of the arm 101 and one end of the web 11 is approximately flush with the end surface 103 of the support arm 101. The bracket 10 is then secured to the support arm 101 by four conventional wood screws (not shown) inserted through the holes 37 in the web 11. For additional strength, the support 10 may also be fastened to the support arm 101 by appropriate conventional screws (not shown) inserted through the holes 33 in the web 11.

After the bracket 10 is mounted on the support arm 101, a conventional mailbox 102 is placed over the bracket 10 so that the side walls 13 of the bracket 10 are disposed between the lower edge portions of the side walls of the mailbox and are each closely adjacent a respective one of the side walls of the mailbox. Appropriate holes (not shown) in the lower edge portion of the side walls of the mailbox 102 are then aligned with the slots 39 and 43 so that suitable fastening bolts 45 can be passed through the aligned slots and holes to thereby fix the mailbox 102 to the support bracket 10 through cooperation with nuts 47.

When the mailbox 102 is situated on the support bracket 10 as shown in FIG. 1, the bottom wall of the mailbox rests on the top edges of the side walls 13. Also, the mailbox 102 generally extends somewhat beyond the ends of the bracket 10. Consequently, it is difficult to insert fingers into the space between the web 11 and the bottom of the mailbox 102 in order to fasten the nuts 47 on the bolts 45. For this purpose, the holes 35 (spaced sufficiently from the center of the web 11 to avoid overlying the arm 101) are provided so that a finger and/or a tool may be inserted at various locations into the space between the web 11 and the bottom of the mailbox for the purpose of holding the nuts 47 while the bolts 45 are tightened.

Although FIG. 1 shows only one side of the mailbox 102 being fixed to the support bracket 10, it will be understood that the other side of the mailbox 102 is secured to the bracket 10 in an identical fashion. Although the middle slot 41 is not used in this illustrative example, the slot 41 may be necessary to fasten mailboxes with varying hole patterns to the support bracket 10.

Referring to FIG. 2, attachment of the support bracket to the top portion of a post 100 will now be described, the post 100 ordinarily being a 4 inch by 4 inch piece of wood. The brace portions 17 are bent at their fixed ends 19 along the line of perforations 23 so as to pivot them to extend out of the plane of the base portion 14 of the web 11 in the direction of the side walls 13. The bracket 10 is then placed on the post 100 with the brace portions 17 extending downwardly and toward the post 100 and the side walls 13 extending downwardly. The support bracket 10 is situated so that the transversely extended center portion 31 of the hourglass-shaped cut-out 15 is approximately centered on the top surface 105 of the post 100. With the support bracket 10 in this position, the holes 33 approximately symmetrically overlie the top surface of the post 100. The base portion 14 of the web 11 is then secured to the post 100 by appropriate wood screws (not shown) inserted through the holes 33. The brace portions 17 are then bent about their fixed ends 19 so that the tabs 25 contact the side surfaces 104 of the post 100. The tabs 25 are then bent about the perforations 29 so that the surfaces of the tabs 25 are flush against the side surfaces 104 of the post 100. Assuming the side surfaces 104 of the post 100 are generally perpendicular to the top surface 105 thereof, it should be clear that in order for the surfaces of the tabs 25 to be flush against the side surfaces 104 of the post 100, the tabs 25 must be bent about the perforations 29 so that they extend at a different angle relative to the plane of the base portion 14 than do the brace portions 17. The tabs 25 are then secured to the post 100 by appropriate wood screws (not shown) inserted through the holes 27. The mailbox 102 is then situated on the support bracket 10 so that the bottom of the mailbox rests on the base portion 14 of the web 11 and the depending lower edges of the mailbox side walls each extend downwardly adjacent a respective side wall 13 of the bracket 10. The mailbox mounting holes are then aligned with the slots 39 and 43, and the bolts 45 are inserted through the aligned slots and holes to thereby fix the mailbox to the support bracket 10. In this case, since the bracket has been inverted, the nuts 47 are easily tightened on the bolts 45 without any interference from the mailbox or bracket.

Figure 3:
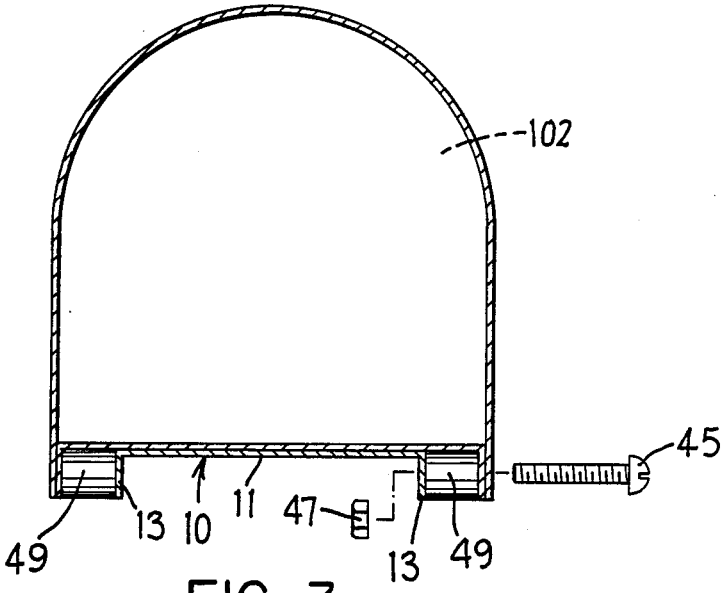
FIG. 3 is a sectional end view showing the inventive support bracket in use with an oversize mailbox.

Referring to FIG. 3, plastic sleevelike spacers 49 are provided to allow the support bracket 10 to be used with oversized mailboxes. The spacers 49 are cylindrical with circular holes formed longitudinally therethrough for receiving the portion of bolt 45 in the region between the lower edge portions of the side walls of the oversized mailbox 102 and the side walls 13 of the support bracket 10. The spacers 49 are preferably inserted between the side walls 13 and mailbox 102 so as to be in snug abutment with both as shown in FIG. 3. Although not shown in the drawing, the spacers 49 may also be similarly employed when the bracket 10 is inverted for the purpose of mounting an oversized mailbox on a horizontally extending arm similar to that shown in FIG. 1.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mailbox support device, comprising a generally horizontally extending main portion, first means for facilitating a fixed support of a mailbox with respect to said main portion, a brace portion having first and second ends, and second means for operatively coupling said first end of said brace portion to said main portion in a manner facilitating movement of said brace portion from a first position in which said second end is adjacent said main portion to a second position in which said second end is spaced from said main portion, said main portion having third means for facilitating a fixed connection of said main portion to a support and said brace portion having fourth means in the region of said second end thereof for facilitating a fixed connection of said second end thereof to a support.

2. A device according to claim 1, wherein said main portion is platelike and has a cut-out therein, said second means including said brace portion being integral with said main portion, said brace portion projecting from its first end into said cut-out when said brace portion is in said first position with respect to said main portion, movement of said brace portion being effected by bending said brace portion at said first end thereof.

3. A device of claim 2, wherein said second means includes a plurality of spaced perforations provided through said brace portion at said first end thereof.

4. A device of claim 3, including a further perforation provided through said brace portion near said second end thereof, said fourth means including an opening provided through said brace portion between said further perforation and said second end of said brace portion.

5. A device of claim 2, including a further brace portion having first and second ends, and fifth means for operatively coupling said first end of said further brace portion to said main portion on an opposite side of said cut-out from said first end of said first-mentioned brace portion in a manner facilitating movement of said further brace portion from a first position in which said second end thereof is adjacent said main portion to a second position in which said second end thereof is spaced from said main portion, said further brace portion having sixth means in the region of said second end thereof for facilitating a fixed connection of said second end thereof to a support, said fifth means including said further brace portion being integral with said main portion, said further brace portion projecting from its first end into said cut-out when said further brace portion is in said first position with respect to said main portion, movement of said further brace portion being effected by bending of said further brace portion at said first end thereof, said brace portions extending into said cut-out in directions toward each other when said brace portions are in their first positions.

6. A device of claim 5, wherein said first means includes two spaced and parallel side wall portions which are secured to and project outwardly in a common direction from opposite edges of said main portion and which each have an opening therethrough, and wherein said device is made from a single piece of sheet metal and said main portion, said brace portions and said side wall portions are integral portions of said piece of sheet metal.

7. A device of claim 6, wherein said main portion has near each said side wall portion a through opening which is sufficiently large to permit insertion of a finger therethrough.

8. A device of claim 6, wherein said cut-out is approximately hourglass-shaped and extends in a direction approximately parallel to said side wall portions, said first ends of said brace portions each being located at a respective end of said cut-out and each said brace portion tapering in width in a direction from said first end to said second end thereof.

9. A device of claim 8, wherein said third means includes a pair of spaced screw openings provided through said main portion on each side of said cut-out near a center portion of said cut-out.

10. A device of claim 9, wherein said main portion has between each end of said cut-out and an adjacent end of said main portion a pair of further screw openings which are spaced from each other.

11. A mailbox support device, comprising a generally horizontally extending main portion, first means for facilitating a fixed support of a mailbox with respect to said main portion, second means for facilitating a fixed connection of said main portion to a support, a brace portion projecting outwardly from said main portion, and means on said brace portion near an end thereof remote from said main portion for facilitating a fixed connection of said brace portion to a support.

12. A device of claim 11, including a further brace portion projecting outwardly from said main portion and spaced from said first-mentioned brace portion, and means on said further brace portion near an end thereof remote from said main portion for facilitating a fixed connection of said further brace portion to a support, said ends of said brace portions which are remote from said main portion being spaced from each other.

13. A device of claim 12, wherein said first means includes spaced and parallel side wall portions which project outwardly in a common direction form opposite edges of said main wall portion and which each have an opening therethrough, and wherein said device is made from a single piece of sheet metal and said main portion, said brace portions and said side wall portions are respective portions of said piece of sheet metal.

14. A device of claim 13, wherein said brace portions are inclined at an acute angle with respect to said main portion, each extending toward the other thereof and in said common direction.

* * * * *